US005873286A

United States Patent [19]

Van Lenten

[11] Patent Number: 5,873,286

[45] Date of Patent: Feb. 23, 1999

[54] FLEX PAWL

[75] Inventor: James A. Van Lenten, Lancaster, Pa.

[73] Assignee: Hand Tool Design Corporation, Wilmington, Del.

[21] Appl. No.: 833,664

[22] Filed: Apr. 8, 1997

[51] Int. Cl.[6] ..... G05G 1/00; B25B 17/00

[52] U.S. Cl. ..... 74/575; 74/577 M; 81/57.29; 81/60; 81/61; 81/63.2

[58] Field of Search ..... 74/575–577 M; 81/57.29, 60–63.2, 177.85

[56] References Cited

U.S. PATENT DOCUMENTS

| | | | |
|---|---|---|---|
| 4,532,832 | 8/1985 | Christensen | 81/57.29 |
| 4,722,252 | 2/1988 | Fulcher et al. | 81/57.39 |
| 5,000,066 | 3/1991 | Gentiluomo | 81/63 |
| 5,269,195 | 12/1993 | Kitagawara | 74/577 M X |
| 5,328,241 | 7/1994 | Haider | 74/577 M X |
| 5,522,288 | 6/1996 | Slusar et al. | 81/63 |
| 5,537,899 | 7/1996 | Diedrich | 81/57.39 |
| 5,582,080 | 12/1996 | Barmore | 81/63 |
| 5,584,220 | 12/1996 | Darrah et al. | 81/57.29 |

*Primary Examiner*—Vinh T. Luong
*Attorney, Agent, or Firm*—Leonard Bloom

[57] ABSTRACT

A pawl for a ratchet wrench to be engaged with a ratchet gear. The pawl has a slot formed on each side of the pawl. The slot extends between the top and the bottom of the pawl near the teeth on the front of the pawl. The pawl flexes to compress the slot when torque is applied to the wrench and engagement between the teeth on the pawl and teeth on the ratchet gear is improved.

7 Claims, 4 Drawing Sheets

FLEX PAWL

CROSS-REFERENCES TO RELATED APPLICATIONS—not applicable.

STATEMENT REGARDING FEDERALLY SPONSORED RESEARCH AND DEVELOPMENTS—not applicable

BACKGROUND OF THE INVENTION

1. Field of the Invention

The present invention relates to a pawl in a ratchet wrench and more particularly, to a pawl which has slots in the sides and can flex under stress.

2. Description of the Related Art

Ratchet wrenches and other tools include a pawl to permit rotation of a gear in a selected direction. The pawl has at least two teeth, separated from one another on a front surface of the pawl. The pawl teeth engage teeth on a separate ratchet gear and transmit torque from the handle to the gear to produce rotation of the gear. Depending upon the positioning or rotation of the pawl, one or the other teeth on the pawl engage the teeth on the gear to move the gear in a clockwise or counterclockwise direction. Due to this engagement, the tooth (or teeth) on the pawl are subjected to large stresses and failure of the system is usually a result of shearing action on the pawl teeth and on the engaging ratchet teeth.

The present invention is directed to reducing the stress on the teeth on the pawl and more evenly distributes the load on the ratchet gear teeth.

BRIEF SUMMARY OF THE INVENTION

It is an object of the present invention to provide a pawl which distributes stress on the pawl teeth and the ratchet gear teeth and produces a tool with a reduced probability of failure when high torque forces are applied. Also improved distribution reduces stress while improving the fatigue life of components.

It is a further object of the present invention to provide a pawl which compensates for manufacturing tolerances.

In accordance with the teachings of the present invention, there is disclosed a pawl for a ratchet wrench to be engaged with a ratchet gear. The pawl has a top, a bottom, a front surface, an opposite back surface, a first side and an opposite second side between the front and back surfaces. Two separate sets of teeth are formed on the front surface of the pawl. A slot is formed in each side, each slot extending between the top and bottom of the pawl. When a selected set of teeth on the front surface of the pawl engage teeth on the ratchet gear, the slot on the respective side of the pawl nearest the selected set of teeth is compressed to more evenly distribute the load thereby relieving stress on the selected set of teeth on the pawl and the teeth on the ratchet gear.

These and other objects of the present invention will become apparent from a reading of the following specification taken in conjunction with the enclosed drawings.

DESCRIPTION OF THE PREFERRED EMBODIMENTS

Figure 1:
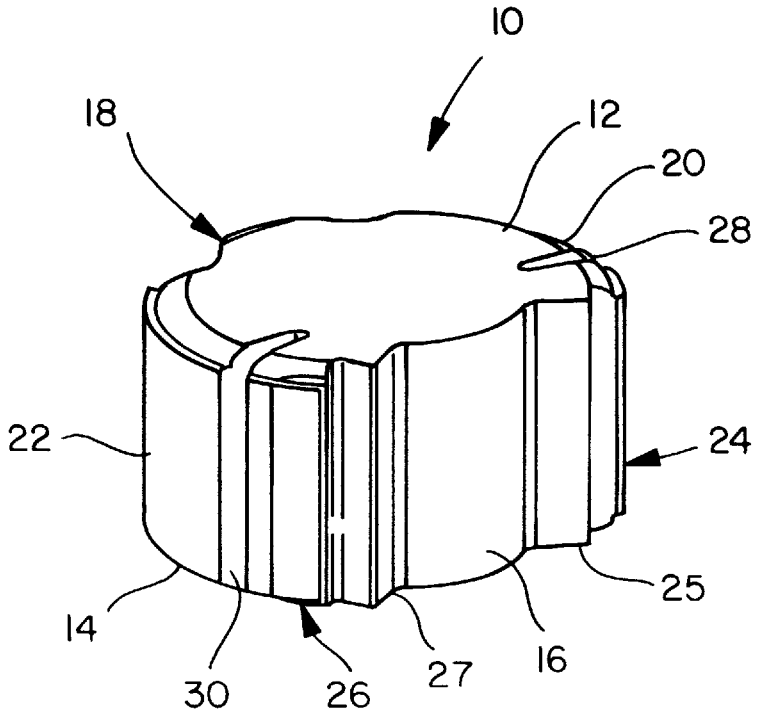
FIG. 1 is a perspective view of the pawl of the present invention.

Referring to FIGS. 1–4, the pawl 10 has a top 12, a bottom 14, a front surface 16, an opposite cam pocket surface 18, a first side 20 and an opposite second side 22. A first set of teeth 24 is formed on the front surface 16 near the first side 20 and a second set of teeth 26 is formed on the front surface 16 near the second side 22 and spaced apart from the first set of teeth 24. Each set of teeth 24, 26 has at least one tooth and preferably has two or more teeth. A first slot or passage 28 is formed in the first side 20 nearer to the front surface 16 than the back surface 18. In a similar manner, a second slot or passage 30 is formed in the second side 22 nearer to the first surface 16 than the back surface 18. The first side 20 is a mirror image of the second side 23.

In a tool such as a ratchet wrench, the selected set of teeth on the pawl 10 engage teeth 34 on a ratchet gear 32 which is rotatably disposed adjacent to the pawl 10. A selection lever (not shown) is connected to the pawl to determine the rotational direction (clockwise or counterclockwise) in which the ratchet gear is driven.

In the prior art, when the teeth on the pawl engage the teeth on the ratchet gear and torque is applied to the system, stress is formed between the respective engaging teeth. As the torque is increased, a point is reached at which the system fails, generally due to breaking of the teeth on either the ratchet gear or the pawl. Also, with multiple teeth on the pawl, the chance of only one tooth carrying the load in the worst tolerance condition is more likely. The material of construction of the pawl and the ratchet gear and the method of manufacture of the respective components, will determine which of the components (ratchet gear or pawl) will fail before the other. The failure of the system is rarely due to problems with the tang (not shown) which is joined to the ratchet gear.

The present invention greatly reduces failure of the teeth on the pawl or the ratchet gear as will be described.

The slots 28, 30 on the sides 20, 22 of the pawl are preferably located near the front surface 16 of the pawl. The slots 28, 30 are identical, each extending from the top 12 to the bottom 14 of the pawl 10. Each slot 28, 30 preferably has a wider mouth which tapers to a narrower apex 36, 38, distal from the respective sides 20, 22. Alternately, the slot 28, 30 could be formed with straight parallel front and back sides or the slot could be arcuate.

Figure 2:
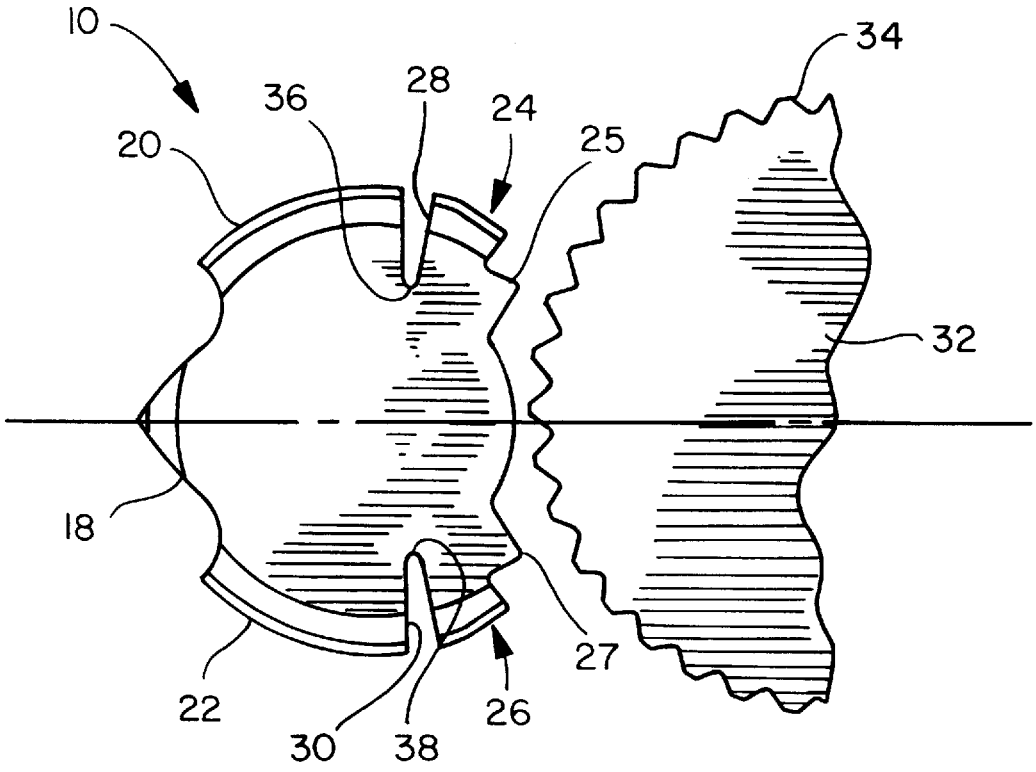
FIG. 2 is a top plan view of the pawl of the present invention and the ratchet gear of the ratchet wrench in a neutral position.
Figure 3:
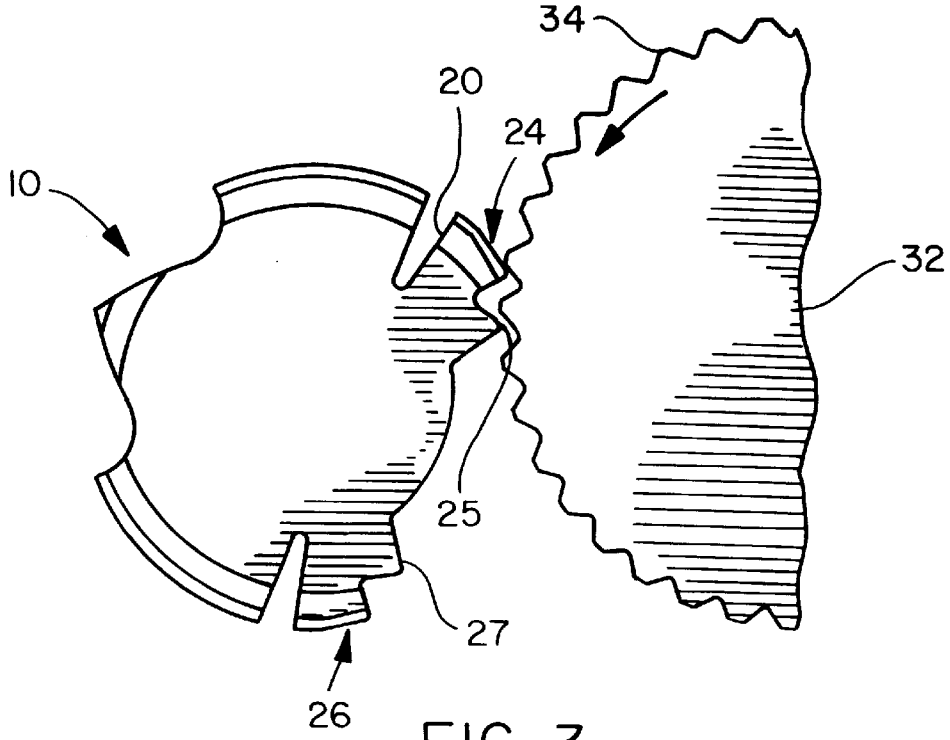
FIG. 3 is a top plan view showing one set of pawl teeth entering engagement with teeth on the ratchet gear.
Figure 4:
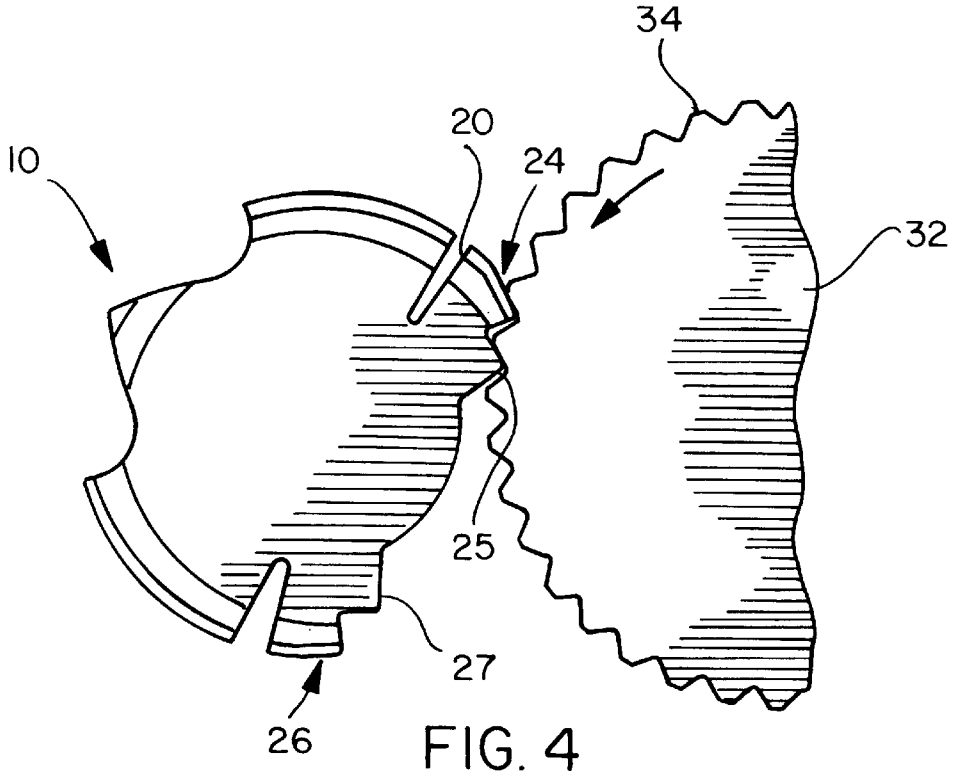
FIG. 4 is the top plan view of FIG. 3 showing torque applied to the system and the pawl flexing in the slot nearest the engaged set of pawl teeth.
Figure 5:
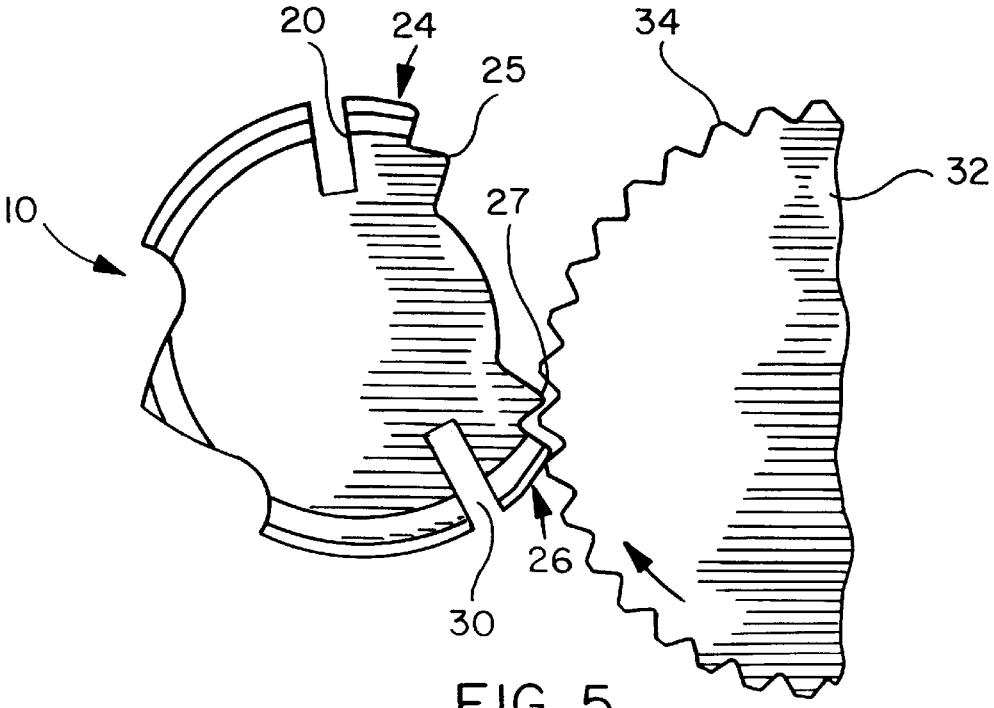
FIG. 5 is a top plan view showing the other set of pawl teeth entering engagement with teeth on the ratchet gear and also showing a slot with straight parallel sides.
Figure 6:
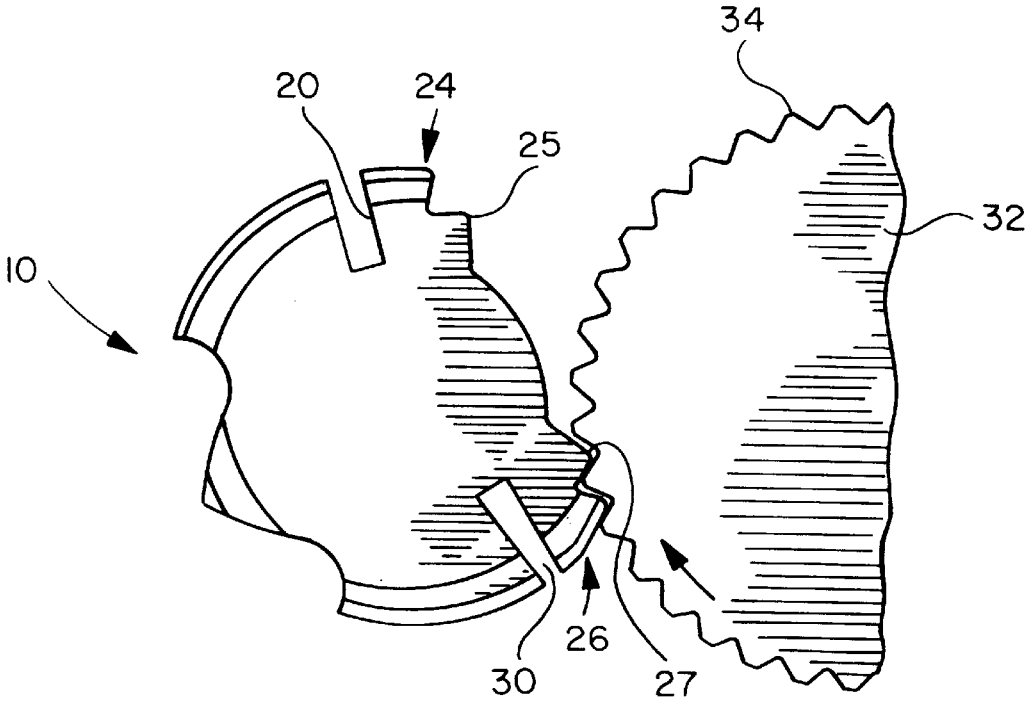
FIG. 6 is a top plan view of FIG. 5 showing torque applied to the system and the pawl flexing in the slot nearest the engaged other set of pawl teeth.

FIG. 2 shows the ratchet gear 32 in a neutral, non-engaged, position with respect to the pawl 10. When the pawl 10 is moved to initially engage the first set of teeth 24 with the teeth 34 on the ratchet gear 32, the slot 28 is in a normal position (FIG. 3). Initial contact is between a point on the tooth 34 on the ratchet gear 22 and a point on the outermost tooth on the pawl 10. As increased torque is applied, for example by rotation of the handle of the ratchet wrench, the first set of teeth 24 on the pawl 10 are pressed toward the slot 28. The pawl 10 flexes to accommodate the forces and the opening in the slot 28 is compressed to relieve stress. The flexed pawl is shown in FIG. 4. The arrow indicates the direction of movement of the ratchet gear 32. Also the load can be distributed over the surface rather than at a point or tip of the tooth. With increased application of torque, even the innermost tooth 25 is in a surface-to-surface contact with the tooth 34 on the ratchet gear 32. Similarly, when the pawl 10 is moved to the alternate position such that the second set of teeth 26 on the pawl 10 engage the teeth 34 on the ratchet gear 32, the pawl flexes and the opening in slot 30 is compressed (FIG. 5 showing the unflexed pawl and FIG. 6 showing the slot compressed and relieving stress). With increased application of torque, the innermost tooth 27 is in surface-to-surface contact with the tooth 34 on the ratchet gear 32. In this manner, stress between the teeth 24, 26 on the pawl 10 and teeth 34 on the ratchet gear 32 is not greatly increased. As a result, significantly increased torque can be applied to the system without producing failure by breaking of the teeth on either the pawl or the ratchet gear. Rather, with the system of the present invention, failures are produced in the tang which can withstand greatly increased forces, which is more easily noticed and is a safer failure mode.

It is preferred that the pawl 10 be formed from a material which is hard and ductile to permit the pawl 10 to flex under the load which is applied.

A further advantage of the pawl of the present invention is that it provides improved contact between the sets of teeth 24, 26 on the pawl and teeth 34 on the ratchet gear 32 to the extent that the performance of the ratchet mechanism is maintained throughout normal manufacturing tolerance bands.

Figure 7:
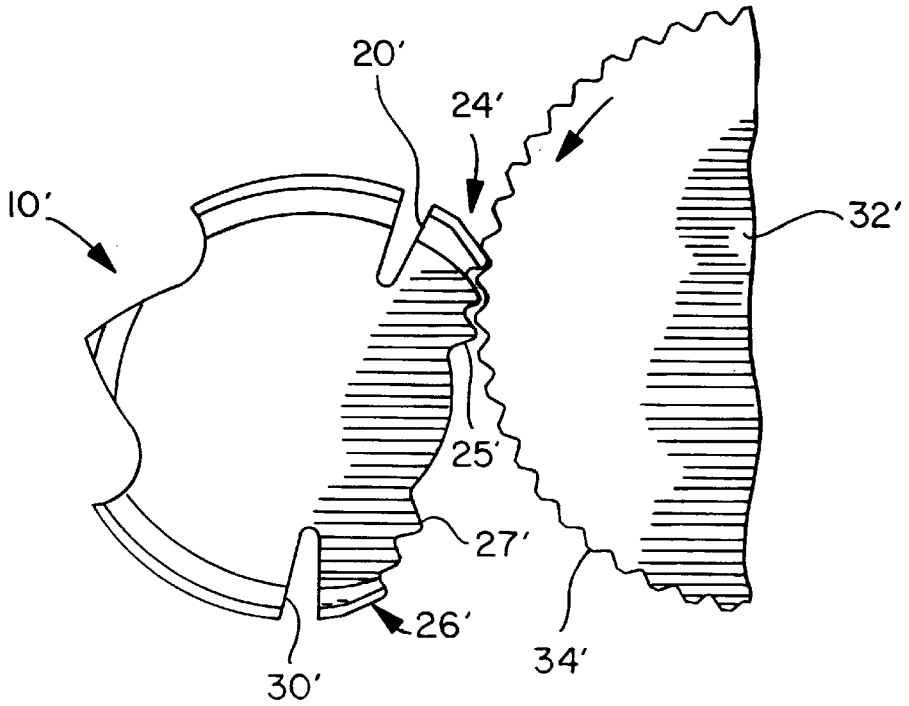
FIG. 7 is a top plan view of another embodiment showing the set of three fine pawl teeth entering engagement with fine teeth on the ratchet gear.
Figure 8:
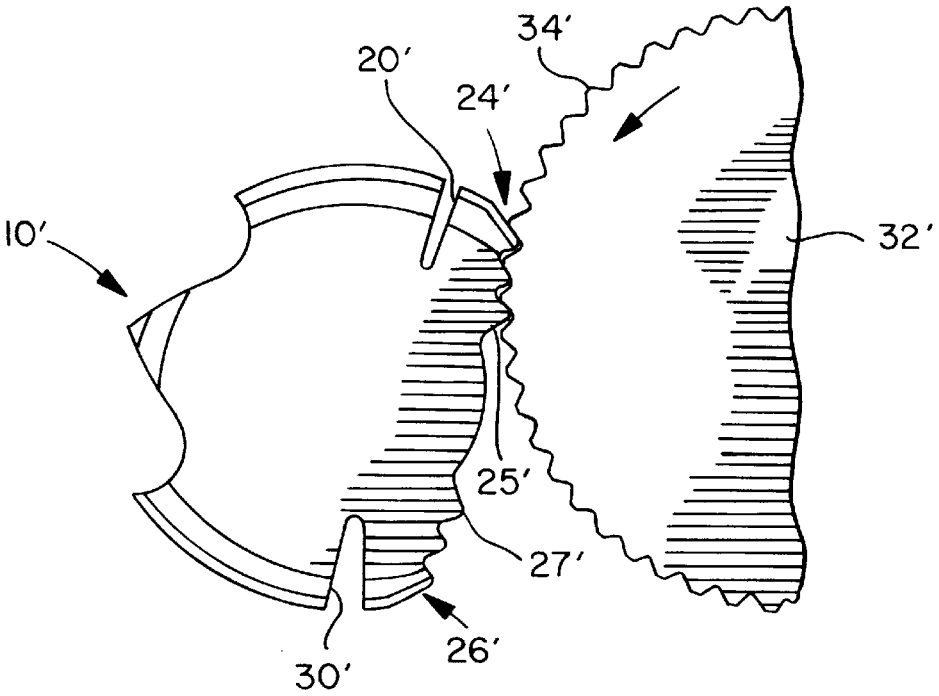
FIG. 8 is the top plan view of FIG. 7 showing torque applied to the system and the pawl flexing in the slot nearest the engaged set of pawl teeth.

A still further advantage of the present invention is that it is possible to have a set of at least three fine teeth in each set 24', 26' on the pawl 10' and to have an increased number of cooperating fine teeth 34' on the ratchet gear 32'. Thus, at least three teeth of the sets 24', 26' on the pawl 10' are engaged at any one time with teeth 34' on the ratchet gear 32' proving an increase in the total area over which the torque forces are transmitted. the innermost tooth 25', 27' of each set 24', 26' is in a surface-to-surface contact with the corresponding tooth 34' on the ratchet gear 32' when maximum torque is applied. This reduces the stress on each of the separate pawl teeth and ratchet gear teeth and permits torque forces to be applied which are greater than possible when fewer (more coarse) teeth are employed. Without the flex-pawl design, finer teeth cannot be used effectively with high torque forces because of the poor engagement resulting from machining tolerance and rotational method of engagement utilized by pawls of current design. The finer teeth also permit the wrench to be under greater control by the user because the backswing can be reduced and the tool can be more effectively used in a confined area. FIGS. 7 and 8 show the relationship between the fine teeth on both the pawl and the ratchet gear and the flexing of the pawl.

Obviously, many modifications may be made without departing from the basic spirit of the present invention. Accordingly, it will be appreciated by those skilled in the art that within the scope of the appended claims, the invention may be practiced other than has been specifically described herein.

I claim:

1. A pawl for use with a ratchet wrench to be engaged with a ratchet gear, the pawl comprising a top, a bottom, a front surface, an opposite back surface, a first side and an opposite second side between the front and back surfaces, two spaced-apart sets of teeth being formed on the front surface, a slot being formed in each side, each slot extending between the top and bottom of the pawl, wherein when a selected set of teeth on the front surface of the pawl engage teeth on the ratchet gear, the slot on the respective side of the pawl nearest the selected set of teeth is compressed to more evenly distribute the load, thereby minimizing stress on the selected set of teeth on the pawl and the teeth on the ratchet gear.

2. The pawl of claim 1, wherein each slot is formed nearer to the front surface than to the back surface of the pawl.

3. The pawl of claim 1, wherein each slot has an apex distal from the side, the slot being most narrow at the apex.

4. The pawl of claim 1, wherein each slot has a respective first side and a back side, the sides being substantially straight and parallel to one another.

5. The pawl of claim 1, wherein the pawl is formed from a material which is ductile wherein the respective sides of the pawl are adapted to flex under load.

6. The pawl of claim 1, wherein each set of teeth on the front surface has at least one tooth.

7. A pawl for use with a ratchet wrench to be engaged with teeth on a ratchet gear, the pawl having a front surface, an opposite back surface, a first side and an opposite second side between the front and back surfaces, two spaced-apart sets of teeth being formed on the front surface, a first stress relieving passage formed in the first side of the pawl and a second stress relieving passage formed in the second side of the pawl diametrically opposed to the first stress relieving passage, wherein when the respective sets of teeth on the pawl engage teeth on the ratchet gear, forces applied against the respective set of teeth on the pawl are transmitted to the stress relieving passage which compresses to minimize stress on the teeth on the pawl and teeth on the ratchet gear.

* * * * *